US005787553A

United States Patent [19]

Liedgens

[11] Patent Number: 5,787,553

[45] Date of Patent: Aug. 4, 1998

[54] SLIVER CAN WITH MANIPULATED BOTTOM WALL

[75] Inventor: Hans-Peter Liedgens, Mönchengladbach, Germany

[73] Assignee: W, Schlafhorst AG & Co., Moenchengladbach, Germany

[21] Appl. No.: 853,811

[22] Filed: May 9, 1997

[30] Foreign Application Priority Data

May 9, 1996 [DE] Germany ..... 196 18 615.3

[51] Int. Cl.[6] ..... D01G 27/00; B65H 54/76

[52] U.S. Cl. ..... 19/159 R

[58] Field of Search ..... 19/159 R, 159 A; 242/361.4, 363; 53/118, 249, 260

[56] References Cited

U.S. PATENT DOCUMENTS

| | | | |
|---|---|---|---|
| 5,237,726 | 8/1993 | Gartenmann et al. | 19/159 R |
| 5,425,159 | 6/1995 | Kluttermann et al. | 19/159 A |
| 5,446,946 | 9/1995 | Leifeld | 19/159 A |
| 5,575,040 | 11/1996 | Leifeld et al. | 19/159 X |

FOREIGN PATENT DOCUMENTS

| | | | |
|---|---|---|---|
| 1395162 | 4/1964 | France | 19/159 R |
| 1362700 | 12/1987 | Russian Federation | 19/159 R |

*Primary Examiner*—Ismael Izaguirre

*Attorney, Agent, or Firm*—Kennedy Covington Lobdell & Hickman LLP

[57] ABSTRACT

A sliver can with improved coupling elements for raising and lowering the bottom wall of the can during filling and otherwise manipulating the cans by can transport vehicles wherein the coupling elements are disposed within the laterally outermost contour of the can and are configured in conjunction with the width of associated guide slits in the side wall of the can to receive laterally movable can manipulators, e.g. on a can transport vehicle, for interlocking connection for transmitting upward movement of the manipulators to the bottom wall of the can and, optionally, lateral movement of the manipulators to the can for pushing and pulling movements.

10 Claims, 7 Drawing Sheets

SLIVER CAN WITH MANIPULATED BOTTOM WALL

FIELD OF THE INVENTION

The present invention relates to sliver cans generally and, more particularly, to a sliver can with a vertically displaceable bottom wall and vertical guide slits in the can side wall, wherein coupling elements attached to the bottom wall in the area of the guide slits are shaped in correspondence to movable bottom wall manipulators to follow at least one upward movement of the manipulators.

BACKGROUND OF THE INVENTION

So-called coupling elements are known to be provided on sliver cans projecting from vertical guide slits in the can wall for use in manipulating the cans and in raising and lowering the bottom wall of the cans during filling of the cans with sliver. Disadvantageously, such cans must be exactly positioned to mate with the so-called manipulators to initiate raising and lowering of the bottom wall vertically. The coupling elements extend far beyond the lateral contour of the can to compensate for tolerances and, hence, constitute interference points or obstructions. In automating textile machine operations, sliver cans must be designed to be handled and manipulated by automatic machinery, in particular by means of automatically controlled can transport vehicles, so that the cans may, for example, be pulled on and pushed off the can transport vehicles.

In order to achieve a uniform placement of the sliver when filling cans with sliver, it is known to raise the bottom wall of the can prior to the filling process and to lower the bottom wall in a controlled manner during filling. For this purpose, some sliver cans are equipped with bottom walls which are raised by springs. In addition, other sliver cans have slits formed in their lateral walls, through which coupling elements fastened on the bottom wall are guided. Sliver can manipulators can act on these coupling elements to raise and lower the bottom wall.

Cans equipped in this manner, and a compatible can filling station designed for such a can filling operation, are known from German Patent Publication DE 44 07 849 A1. The cans to be filled at this known can filling station are rectangular cans. The coupling elements protrude from the slits on the narrower side of the can. These coupling elements must protrude past the can contour for a defined length, including an extra protruding length to provide a tolerance, so that the coupling elements can still be securely gripped by the spaced-apart manipulators, sometimes referred to as support elements, which are delivered to the can in the direction of the shorter rectangular sides of the can. Such a lifting device requires a very accurate and therefore elaborate positioning of the can between the support elements, so that the coupling elements do not strike the can while being delivered to it. Since the coupling elements rest only loosely on the support elements, a disruptive horizontal relative movement between the can walls and the bottom wall may potentially occur because of the back-and-forth movement during filling. Furthermore, the coupling elements projecting past the outer contour of the cans may constitute sources of disruption. For example, the can walls may be damaged when cans collide, and operators may bump against the coupling elements or stumble over them. During pulling and pushing of the cans, for example when loading and unloading a can transport vehicle, a coupling element projecting beyond the outer contour of the can may also cause problems when a height difference exists, particularly if the can tilts during the displacement so as to temporarily rest on the coupling element.

SUMMARY OF THE INVENTION

It is accordingly an object of the present invention to provide an improved sliver can with a bottom wall which can be adjusted in its elevation or height and whose handling is improved over the prior art.

The invention basically resides in a sliver can having a side wall and a vertically displaceable bottom wall, wherein the side wall defines a laterally outermost can contour (including the perimeter edges of the can) and has vertical guide slits formed in the side wall, and the bottom wall has coupling elements disposed adjacent the guide slits to be connectable with can manipulators to follow a vertical movement of the manipulators. According to the present invention, the coupling elements are configured to be disposed within the can contour, and the coupling elements and the guide slits are compatibly configured to permit insertion of the manipulators laterally into the coupling elements.

In this manner, no coupling elements project interferingly past the contour of the can. The shape of the coupling element in conjunction with the width of the guide slit permit the establishment of an interlocking connection with can manipulators when moved laterally toward the interior of the can, which enables at least the transmission of raising movements to the bottom wall of the can. The downward movement of the bottom wall, which takes place automatically because of gravity, can also be controlled with the aid of the manipulators.

As a rule, openings or recesses are formed on the coupling elements, which receive the respective manipulators. However, contoured portions or elements projecting away from the coupling elements are also conceivable for entering the manipulators in the course of their advancement to the can to establish an interlocking connection therebetween.

Exact positioning of the can at the can filling station is not necessary for proper performance of the sliver can of the invention. By delivering the manipulators to the can from opposite sides laterally toward the interior of the can, the can is thereby automatically centered between the manipulators. One of the manipulators can even be fixed on a carriage of a traversing device at a can filling station and can be simultaneously used as a stop or engagement for the can when it is pushed onto the traversing device, while the oppositely located manipulator may be pivoted for movement out of the transport path during the transfer of the can to and from the traversing device. Thus, if the traversing device is equipped in this manner, the can may be transported onto the traversing device during its delivery until the fixed manipulator enters the opening or recess of one coupling element on the can and thereby stops the can. Then, the opposite manipulator is pivoted into its operating position and is displaced in the direction of the longitudinal axis of the can until it has also entered the opening of the other coupling element on the can. For centering the can, both manipulators can then be advanced toward one another toward the interior of the can. The advancement of the driven manipulators can be stopped, for example by means of pressure sensors, when they have reached their end positions. When both manipulators have been inserted into the openings of the coupling elements, an interlocking connection exists between the manipulators and the coupling elements, and the bottom wall can at least be raised or lowered.

During filling of the can, the can and its bottom wall are mutually clamped in the traversing device, so that no undesired relative movement occurs between the bottom wall and the side wall of the can.

In one advantageous embodiment of the invention, the coupling elements have a portion configured for interlocking connection with the manipulators for additionally following lateral movements of the manipulators for pushing and pulling movements of the cans in addition to raising and lowering of the bottom wall of the can. Alternatively, the coupling elements and the slits in the side wall may be compatibly arranged to receive the manipulators in interior engagement with the side wall of the can for similarly following lateral movements of the manipulators for pushing and pulling movements of the can.

In order to be able to make interlocking engagement with a coupling element or a can wall, the manipulators are preferably designed in configuration and operation similarly to a key for insertion into and removal from a coupling element in only a predetermined orientation, which considerably improves the effectiveness during use. If, following insertion into the opening of a coupling element, a manipulator is rotated over a predeterminable angle like a key in a lock, it lockingly engages the contour of the coupling element or the interior of the side wall of the can. In such a position of the manipulator, the can may also be pushed and pulled laterally. Can transport vehicles as a rule have manipulators designed in this manner in order to pull the cans out of the filling station or from under a work station of a textile machine onto the can transport vehicle.

The design of the coupling elements can be matched to the type of the can and to the respective device for manipulating the cans on a can transport vehicle. If the bottom wall has a flange about its perimeter which forms a collar about the bottom wall and is disposed adjacent the side wall of the can, the bottom rests securely within the side wall against tilting movements. In this case, the coupling element can be simple in structure. An opening or recess, into which the manipulators are centered, is sufficient for raising and lowering the bottom wall, for example at a filling station. However, for pulling and pushing the can, in particular by the manipulators of a can transport vehicle, the coupling elements must be configured to make possible an interlocking connection with the manipulator or an interlocking connection between the can wall and the manipulator.

The coupling elements can also be designed to extend into the guide slit. Coupling elements of this type are advantageous if the bottom wall is not equipped with a perimeter flange or collar or otherwise is not securely oriented within the side wall of the can. Thus, the extension of the coupling elements into the slits stabilizes the disposition of the bottom wall.

In a further embodiment of the invention, the coupling elements can extend out of the can beyond the guide slits into overlapping relation therewith. The portion of a coupling element overlapping the guide slit should be of a thickness that does not project beyond the outer contour of the can circumference, i.e., beyond a rim outwardly projecting from the can wall. In this manner, the coupling elements do not create a protruding, interfering obstacle. Interfering corners or edges, which might cause hooking or catching on obstacles, are advantageously avoided if the portions of the coupling element overlapping the guide slit are beveled or tapered toward the can wall.

According to a further aspect of the invention, the coupling element includes a magnetizable material. A transport vehicle with a mechanical changer for sliver cans is known from German Patent Publication DE 43 23 726 A1, and has a magnet which can be selectively actuated to attach with a magnetizable metal plate solidly fixed on the can. In the present case, the portion of the coupling element disposed outside of the side wall of the can may serve a comparable function by configuring to have dimensions adapted to manipulation by means of a magnet.

Coupling elements equipped in this manner not only serve the function of coupling the sliver can with a manipulator, but also provide engagement points for the manipulators for raising and lowering the bottom wall. For example, corresponding openings or recesses may be provided in the coupling elements for the manipulators.

Insertion of the manipulators is made easier by forming the receiving recesses or openings in the coupling elements for the manipulators with a conical tapering. When inserting the manipulators, it is thus possible to tolerate some offset in height between the axis of the manipulator and the axis of the opening. The conical opening furthermore makes it easier to overcome a small step-like height difference by the can, because it permits a slight tilting movement of the can. An arrangement permitting a swinging movement of the manipulators is also possible.

The sliver cans in accordance with the invention are preferably rectangular cans, which avoids special provisions for relative orientation of the manipulators. However, the invention can also be advantageously employed with round cans. A round can is known from German Patent Publication DE 43 35 173 A1, on whose bottom a polygonal pallet is fastened. Thus, the coupling elements could be oriented toward a predetermined side of the pallet, which is used for orienting the can during automatic manipulation.

The invention will be explained in greater detail below by means of exemplary embodiments in relation to the accompanying drawings.

DETAILED DESCRIPTION OF THE PREFERRED EMBODIMENTS

Figure 1:
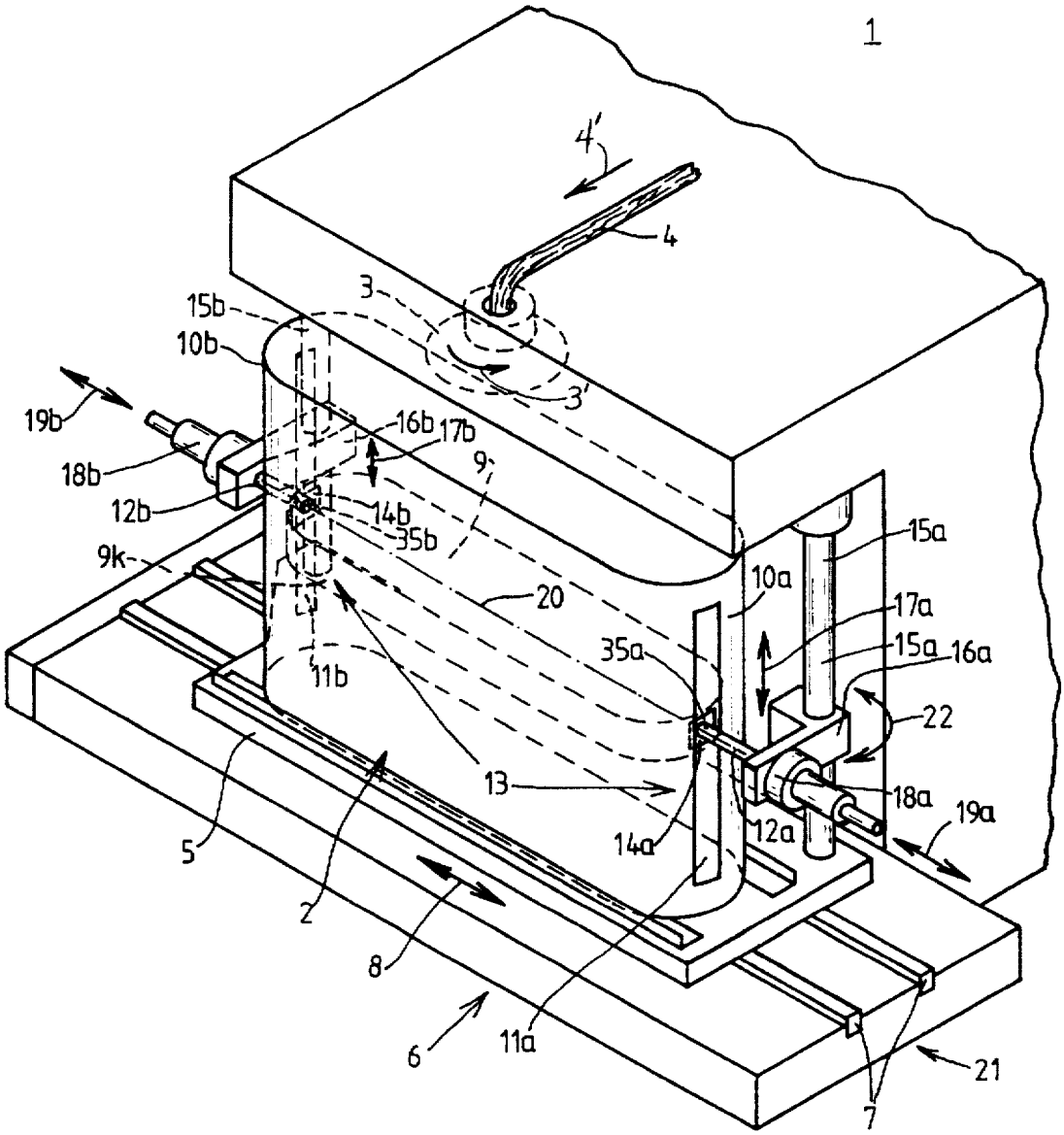
FIG. 1 is a perspective view of a sliver can filling station with a sliver can in accordance with the present invention disposed in the filling position.

Referring now to the accompanying drawings and initially to FIG. 1, a can filling station 1 is schematically represented with a can 2 in accordance with the present invention in the process of being filled with an incoming sliver 4 being delivered in the direction of the associated arrow 4' from a drafting roller (not shown). The sliver can 2 has a rectangular cross section and is seated on a turntable 3 which rotates in the direction of the associated arrow 3'. During filling, the can 2 stands on a rectangular carriage 5 of a traversing device, indicated as a whole by 6. As indicated by the arrow 8, the carriage 5 is moved back and forth along the guides 7 underneath the turntable 3 by means of a drive (not shown). Simultaneously, the bottom wall 9 of the can 2 is gradually lowered in accordance with the amount of sliver deposited into the can 2. Vertically extending guide slits 11a and 11*b* are formed in the front faces 10*a* and 10*b* of the can 2. Manipulators 12*a* and 12*b* of a device 13 for raising and lowering the bottom wall 9 of the can are in operative connection with coupling elements 14*a* and 14*b* of the can 2 which project through these guide slits 11a and 11*b*. Guidance of the bottom wall 9 along the side walls of the can 2 is provided by a sheet metal plate 9*k*, which encircles the perimeter of the bottom wall in the form of a collar and simultaneously prevents tilting movements of the bottom wall during raising and lowering.

The raising and lowering device 13 comprises two vertically arranged guides 15*a* and 15*b*, which are respectively disposed at the narrow sides of the rectangular carriage 5, adjacent to the area supporting the can 2. A pair of supports 16a and 16*b* for the manipulators 12*a* and 12*b* are mounted on the guides 15*a* and 15*b* to be respectively raised and lowered by means of drives (not shown) as indicated by the arrows 17*a* and 17*b*. The manipulators 12*a* and 12*b* can be moved toward and away from one another by extension and retraction horizontally from the supports 17*a* and 16*b*, as indicated by the arrows 19*a* and 19*b*, by drives 18*a* and 18*b*. In this manner, the manipulators 12*a* and 12*b* can be brought into operative connection with the coupling elements 14*a* and 14*b* by forward movement toward one another in the direction of the longitudinal axis 20 of the can 2, whereby the manipulators 12*a* and 12*b* enter into openings 35a and 35b of the coupling elements. The support 17*a* for the manipulator 12*a* adjacent the loading and unloading station 21 can be horizontally pivoted around its guide 15*a*, as indicated by the arrow 22, in order to enable loading and unloading sliver cans to and from the carriage 5 at the loading and unloading station 21.

Figure 2:
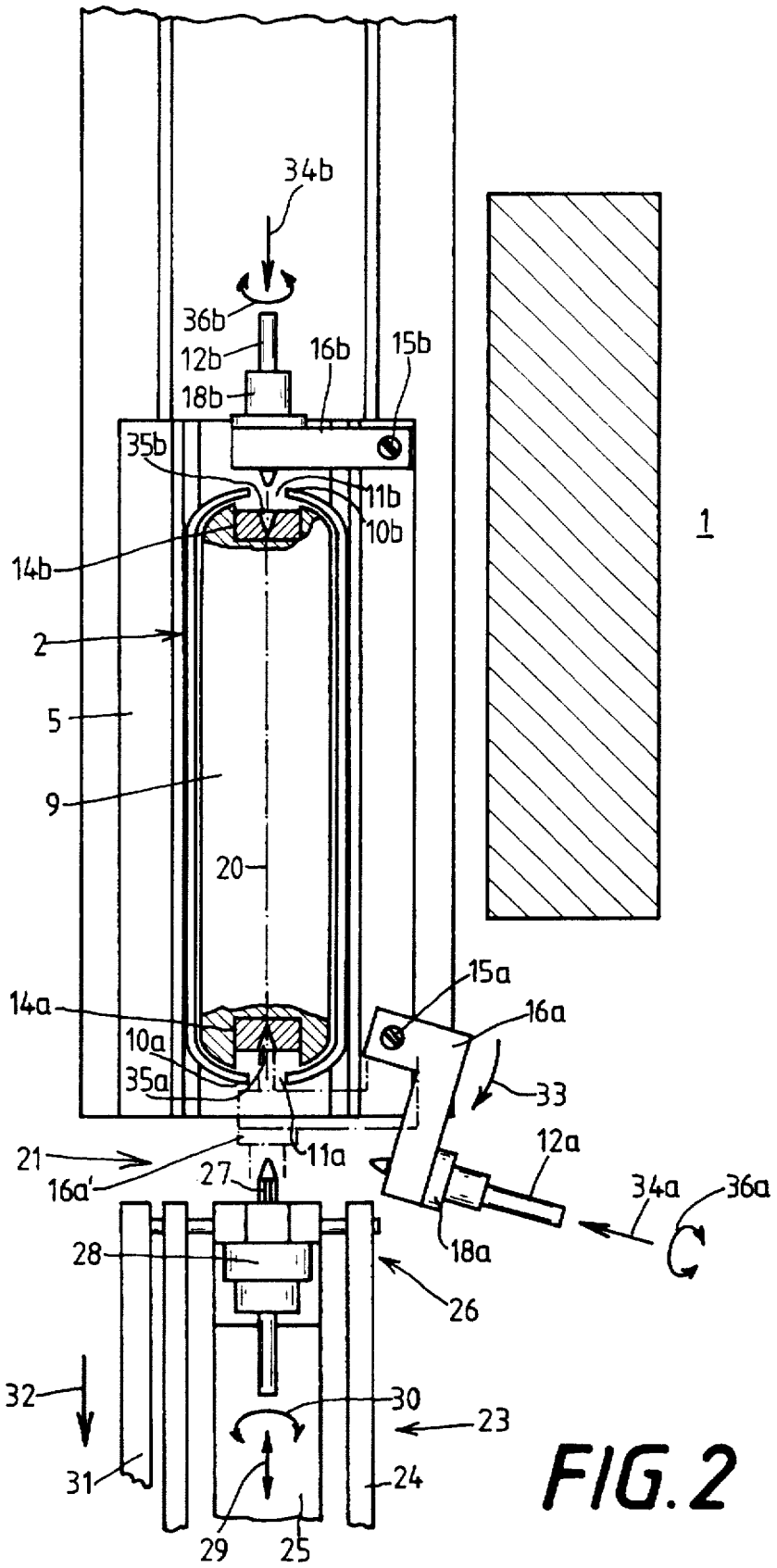
FIG. 2 is a horizontal cross-sectional view taken through the can filling station of FIG. 1, showing the filling station during the transfer of an empty can by a can transport vehicle (not shown)

In a top view, FIG. 2 illustrates the process of loading of the carriage 5 at the can filling station 1 with an empty can 2. For the sake of clarity the filling device has been omitted. The carriage 5 is shown to have been advanced to the loading and unloading station 21, and the support 17*a* for the manipulator 12*a* has been pivoted around its guide 15*a* from its work position 16*a*', shown in broken lines, to a retracted position, shown in full lines, in order to clear the path for transfer of the can onto the carriage 5.

A can changing mechanism, generally indicated at 23, is shown to have been extended from a transport vehicle (not shown) and basically comprises an extended carriage 24 which supports a conveying device 25 connected with a can manipulating device 26 having a manipulator 27 and a drive 28 for extending and retracting the manipulator, as indicated by the arrow 29, and rotating the manipulator about its longitudinal axis, as indicated by the arrow 30. As illustrated, the can changing mechanism 23 has just placed an empty can 2 onto the carriage 5 of the sliver filling station 1 and is being retracted in the direction of the arrow 32 to the can transport vehicle (not shown) by means of a chain 31 acting on the carriage 24.

After the can changing mechanism 23 has been retracted, the support 17*a* with its manipulator 12*a* is pivoted in the direction of the arrow 33 into the work position 17*a*' (shown in broken lines). Subsequently the manipulators 12*a* and 12*b* are advanced toward one another to be engaged with the coupling elements 14*a* and 14*b* on the bottom wall 9 of the can 2 by a synchronous movement of the drives 18a and 18*b* in the direction of the longitudinal axis 20 of the can 2 toward the can interior, as indicated by the arrows 34*a* and 34*b*. The coupling elements 14*a* and 14*b* have conical openings 35*a* and 35*b*, which assist the insertion of the manipulators 12*a* and 12*b*. When the manipulators 12*a* and 12*b* are in operative engagement within the conical openings 35*a* and 35*b* of the coupling elements 14*a* and 14*b*, the forward movement of the manipulators can be stopped, for example through a control means utilizing sliding clutches or pressure sensors. The can 2 is brought into a position which is optimal for filling by a synchronous forward movement of the two supports 17*a* and 16*b* toward one another. The bottom wall 9 of the can 2 is lifted into the sliver filling position by means of a synchronous lifting movement of the two supports 17*a* and 16*b* along the guides 15*a* and 15*b* (which can be assisted by a rigid connection of the two supports, not shown) and, thereafter the bottom wall 9 is lowered during the sliver filling process by a synchronous lowering movement of the two supports 17*a* and 16*b*.

The manipulators can also be configured or provided with suitable devices which permit their insertion into the coupling elements only in one position, in similar manner to the provision of a key with a bit or other configuration which prevents the key from being inserted into a keyhole except in a single position and prevents removal of the key after only a brief turning. Thus, after the manipulators are inserted into the coupling elements and then rotated by a predetermined angle in respect to their insertion disposition, as is respectively represented by the arrow 36*a* at the manipulator 12*a* and 36*b* at the manipulator 12*b*, the manipulators engage behind the end wall of the can or into recesses in the coupling elements. A connection of this type with the can or the coupling element also particularly enables the manipulators on the can changing mechanisms of the can transport vehicles to pull the filled cans from the can filling station to the can transport vehicles, or the empty cans from under the work stations at the textile machines to the can transport vehicle.

Once a can 2 has been completely filled with sliver and the bottom wall 9 has been lowered, the manipulators 12*a* and 12*b* are withdrawn from the coupling elements. Thereafter the support 16*a* with the manipulator 12*a* is pivoted into the position represented in full lines in FIG. 2 and, then, the can changing mechanism 23 in the carriage 5 is moved opposite the direction of the arrow 32 to the loading and unloading station 21. The manipulator 27 is extended through the guide slit 11*a*, inserted into the opening 35*a* of the coupling element 14*a* (as indicated by arrow 29) and, after being turned about its longitudinal axis, engages behind the end wall 10*a* as described above. The filled can 2 now can be pulled onto the carriage 24 and thus onto the can transport vehicle.

Exemplary embodiments of coupling elements and manipulators suitable for the above-described uses and operations are shown in the drawings.

Figure 3:
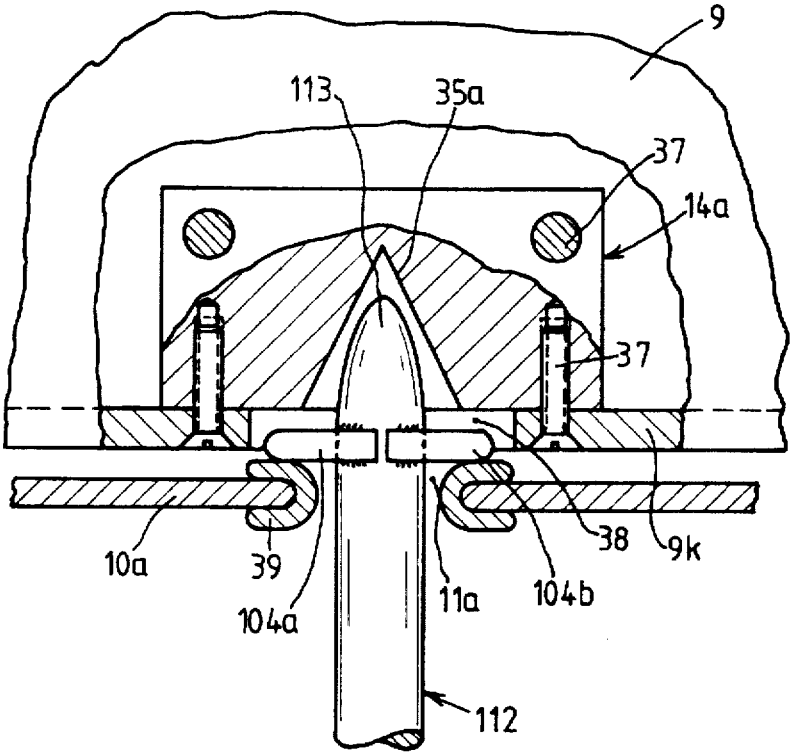
FIG. 3 is an enlarged view, partially in elevation and partially in cross-section, showing a coupling element of the sliver can, which does not extend past the contour of the bottom wall of the can, in engagement with a manipulator.

FIG. 3 depicts one embodiment of coupling element, indicated at 14*a*, as used for manipulating the bottom wall of the can as described in respect to FIG. 2. The coupling element 14*a* is fastened by means of screws 37 on the underside of the bottom wall 9 and on its annular flange 9*k* (or a corresponding form of sheet metal plate defining a collar enclosing the bottom wall) which is used for guiding the bottom wall along the side and end wall of the can. The flange 9*k* has a slot 38, through which a manipulator can be inserted into the conical opening 35*a* in the coupling element. The end wall 10*a* of the can with the guide slit 11a is situated outwardly adjacent the bottom wall 9. The can walls are preferably made of a sufficiently sturdy material such as fiberglass-reinforced plastic, for example, and the edges of the end wall 10*a* defining the guide slit 11*a* are enclosed by U-shaped metallic profiles 39 for reinforcement and wear protection.

In FIG. 3, the manipulator 112 has been inserted into the coupling element 14*a*. The manipulator has a conical end tip 113, which is easier to insert into the guide slit 11*a* and then into the conical opening 35 of the coupling element located inwardly adjacent the guide slit 11*a*. The manipulator 112 also has two wings 104*a* and 104*b* extending radially outwardly from adjacent the tip 113 in diametrically opposed alignment to one another to lie in a common plane, by which the manipulator engages inwardly the end wall 10*a* of the can. In this manner, the manipulator 112 is not only capable of raising and lowering the bottom wall 9, but also enables pulling of the can 2 laterally. The manipulator 112 is therefore also an exemplary embodiment of a manipulator 27 disposed on the can changing mechanism 23 (FIG. 2) for transferring cans between the can changing mechanism and the can filling station 1.

Figure 3A:
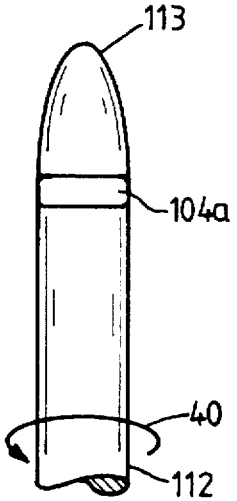
FIG. 3*a* is an elevational view of the manipulator of FIG. 3 rotated into the insertion position.

FIG. 3*a* depicts the manipulator 112 in its insertion disposition rotated to orient the wings 104*a* and 104*b* vertically to allow insertion through the guide slit 11*a* and into the coupling element 14*a*. Upon rotation of the manipulator 112 by 90 degrees, as indicated by the arrow 40, the manipulator is oriented in the manipulating position represented in FIG. 3, with its wings 104*a* and 104*b* engaged inwardly with the end wall 10*a* of the can.

Figure 4:
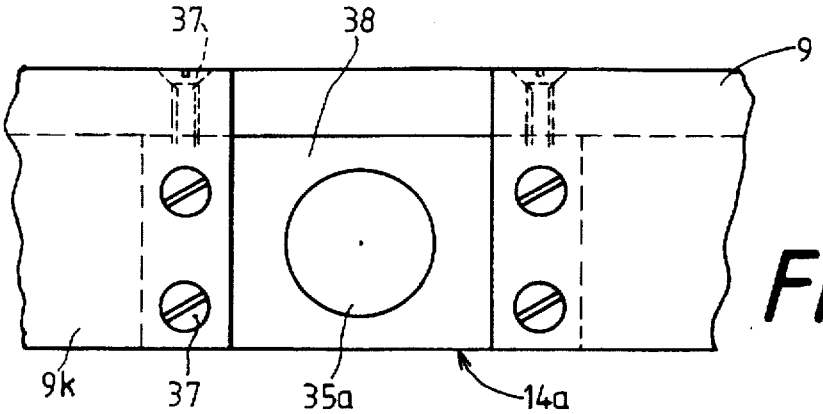
FIG. 4 shows the coupling element in FIG. 3 in elevational view.

FIG. 4 is an elevational view of an end portion of the bottom wall 9 showing the mounted disposition of the coupling element 14*a* on the bottom wall 9 and showing the accessibility of the conical opening 35*a* of the coupling element 14*a* through the slot 38 in the flange 9*k*, which makes the insertion of a manipulator easier.

Figure 5A:
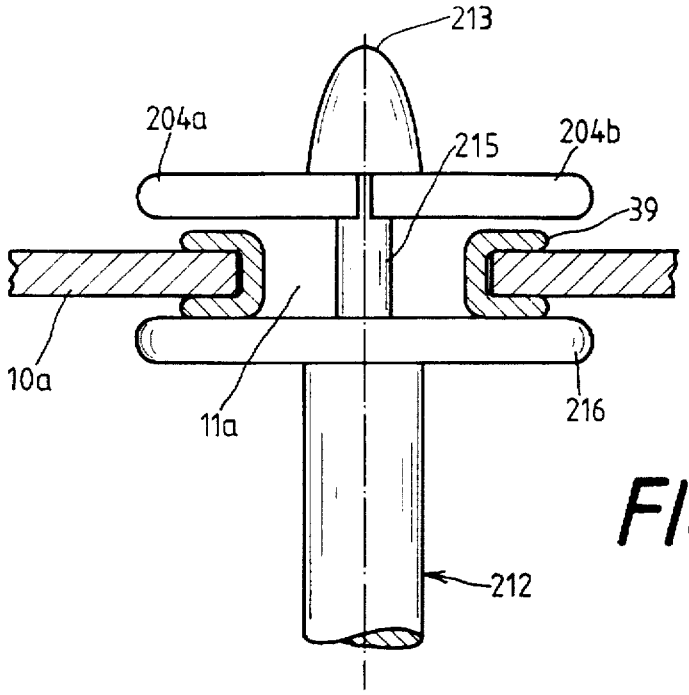
FIG. 5*a* is a view similar to FIG. 3, showing a further embodiment of a manipulator in the insertion position.
Figure 5B:
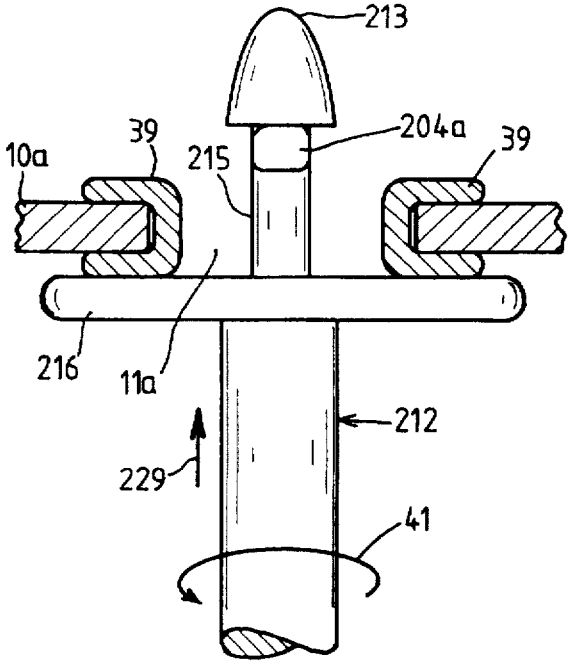
FIG. 5*b* shows the manipulator of FIG. 5*a* in an interlocking connection with the can.

FIGS. 5*a* and 5*b* show another manipulator 212 which is configured to engage opposite sides of the end wall 10*a* of a can, upon insertion of the manipulator 212 in the direction of the arrow 229 through the guide slit 11*a* and into a coupling element (not shown) and subsequent rotation 90 degrees in the direction of the arrow 41. The manipulator 212 has a conical end tip 213, which makes easier the insertion of the manipulator into the guide slit 11*a* in the can wall 10*a* and into a conical opening of a coupling element. Two diametrically opposed and aligned wings 204*a* and 204*b* extend radially in a common plane adjacent the tip 213. An axial bar 215 extends rearwardly from centrally between the wings 204*a* and 204*b* in alignment with the tip and has a cross-sectional thickness approximately corresponding to the collective thickness at the guide slit 11*a* of the can wall 10*a* and the reinforcing U-shaped profiles 39. An annular flange 216 extends radially from the rearward end of the bar 215 and has a diameter approximately corresponding to the lateral dimension between the outer ends of the wings 204*a* and 204*b*. The annular flange 216 limits the maximum extent of insertion of the manipulator into the guide slit 11*a* and, together with the wings 204*a* and 204*b*, serves as a guide for movement of the manipulator along the guide slit 11*a*, for example during raising and lowering of the bottom wall 9. A manipulator of this type is particularly suited for lateral pulling and pushing of cans, and can therefore be employed in a can changing mechanism of a can transport vehicle.

Figure 6:
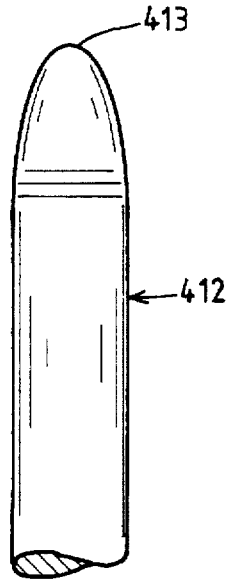
FIG. 6 is an elevational view of another manipulator for raising and lowering the bottom wall.

Another embodiment of manipulator 412 is depicted in FIG. 6. The manipulator 412 also has a conical tip 413 to promote insertion into the guide slit and the conical opening of a coupling element, but is not provided with any wings or comparable structure, whereby the manipulator 412 is exclusively adapted for raising and lowering of the bottom wall of sliver cans.

Figure 8:
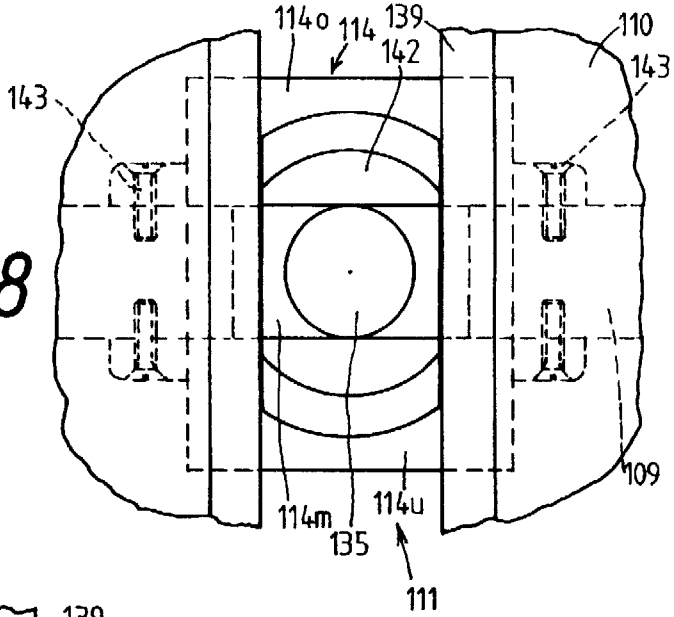
FIG. 8 is an elevational view of the coupling element of FIG. 7 in the guide slit.
Figure 9:
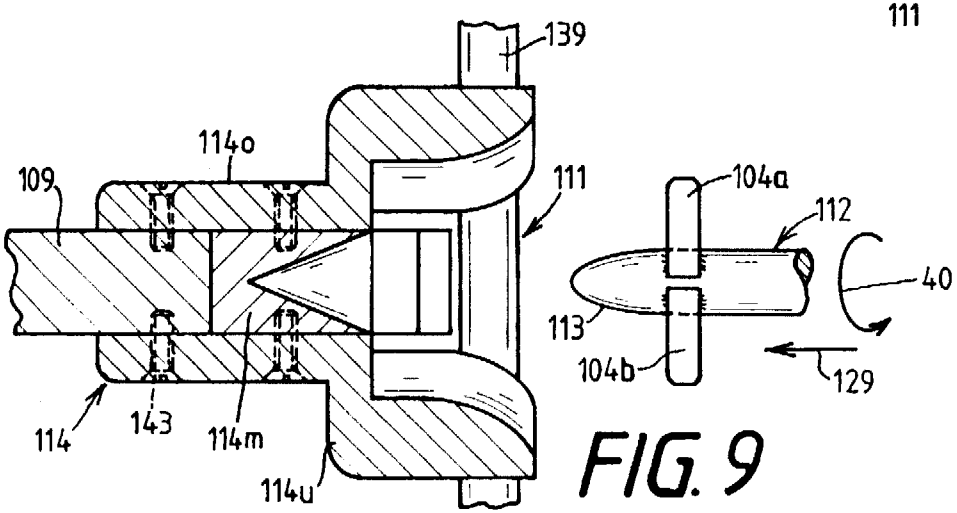
FIG. 9 is a vertical cross-sectional view taken through the coupling element of FIG. 7 with a manipulator in the insertion position.
Figure 7:
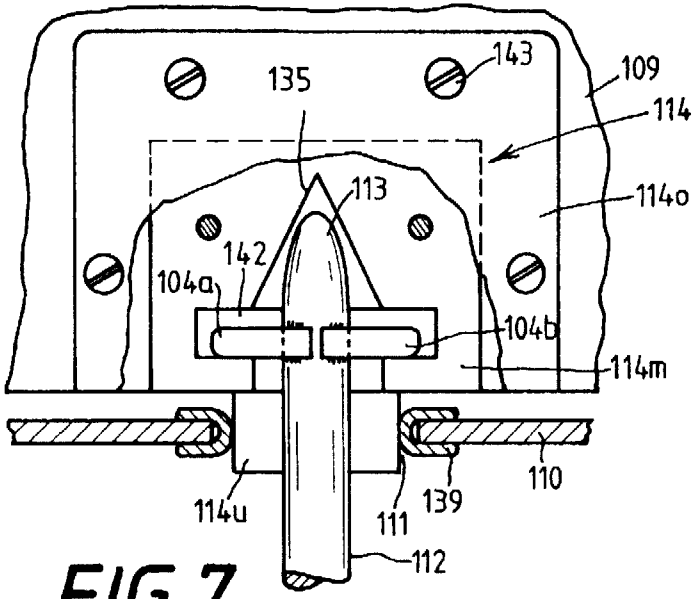
FIG. 7 is a view similar to FIG. 3, showing another embodiment of a coupling element according to the present invention, engaging the guide slit of the sliver can.

FIGS. 7 to 9 depict an exemplary embodiment of a coupling element 114 which is configured to extend through the guide slit 111 of the end wall of a sliver can, whereby the coupling element 114 is particularly suited to be employed in sliver cans whose bottom walls 109 do not have a perimeter flange or collar for stabilizing the position of the bottom wall during raising and lowering. In the instant exemplary embodiment, the coupling element 114 is composed of three parts. As the sectional view in FIG. 7 shows, a central body 114*m* defines a conical recess 135 for receiving and centering an inserted manipulator and a circular recess 142 adjoining and extending radially outwardly from the conical recess, which can be engaged, for example, by the wings 104*a* and 104*b* of a manipulator 112 upon insertion in the axial direction indicated by the arrow 129 and rotation by 90 degrees in the direction of the arrow 40 (FIG. 9), whereby the can may be pulled and pushed laterally by means of the manipulator. The central body 114*m* is fitted into a mating recess in the bottom wall 109, as shown in FIG. 7, and is held between mated upper and lower jaw members 114*o* and 114*u* which are affixed with the bottom wall 109 and the central body by screws 143 as shown by the sectional view of the coupling element in FIG. 9. The upper and lower jaw members 114*o* and 114*u* extend through and engage in the guide slit 111 formed in the wall 110 of a can between the reinforcing U-shaped profiles 139 (FIGS. 7 and 8). The upper and lower jaw members 114*o* and 114*u* are spaced apart and shaped so as to enable the insertion of the manipulator 112 in the direction of the arrow 129 when rotated to orient the wings 104*a* and 104*b* vertically, as can be seen in FIGS. 8 and 9. FIG. 8 is an elevational view of the coupling element 114 disposed behind the guide slit 111 in the end wall of the can, taken in alignment with the conical recess.

Figure 11:
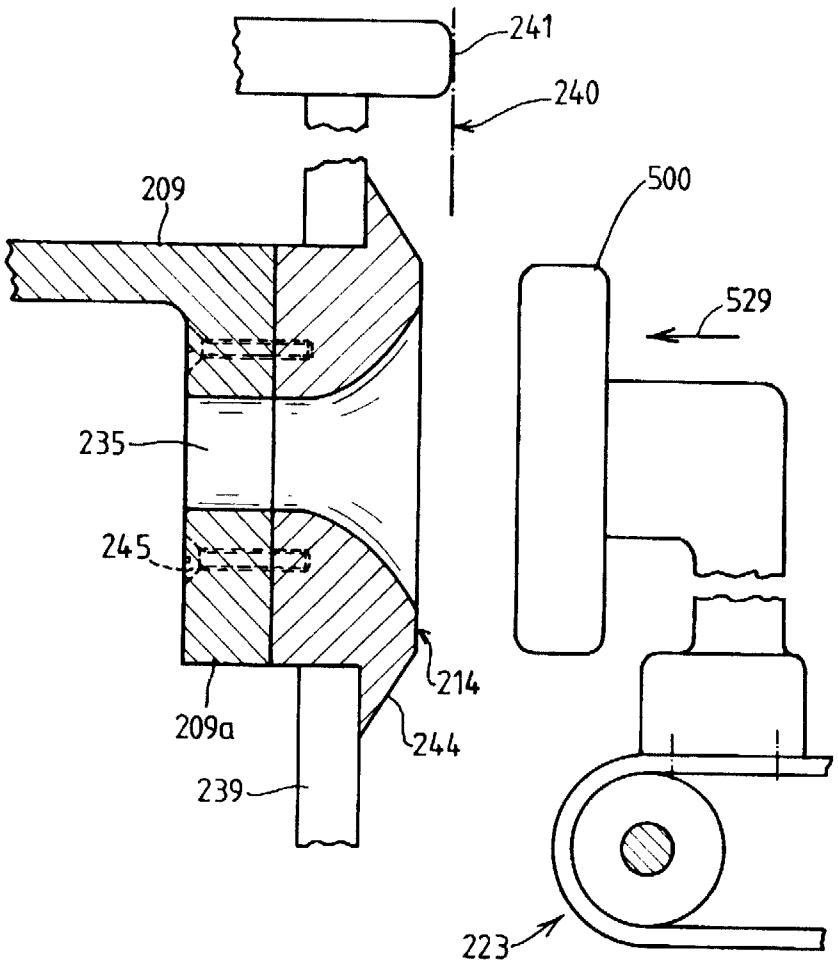
FIG. 11 is a vertical cross-sectional view through the coupling element of FIG. 10 with the can manipulator of a can transport vehicle comprising a magnet disposed forwardly adjacent the coupling element.
Figure 10:
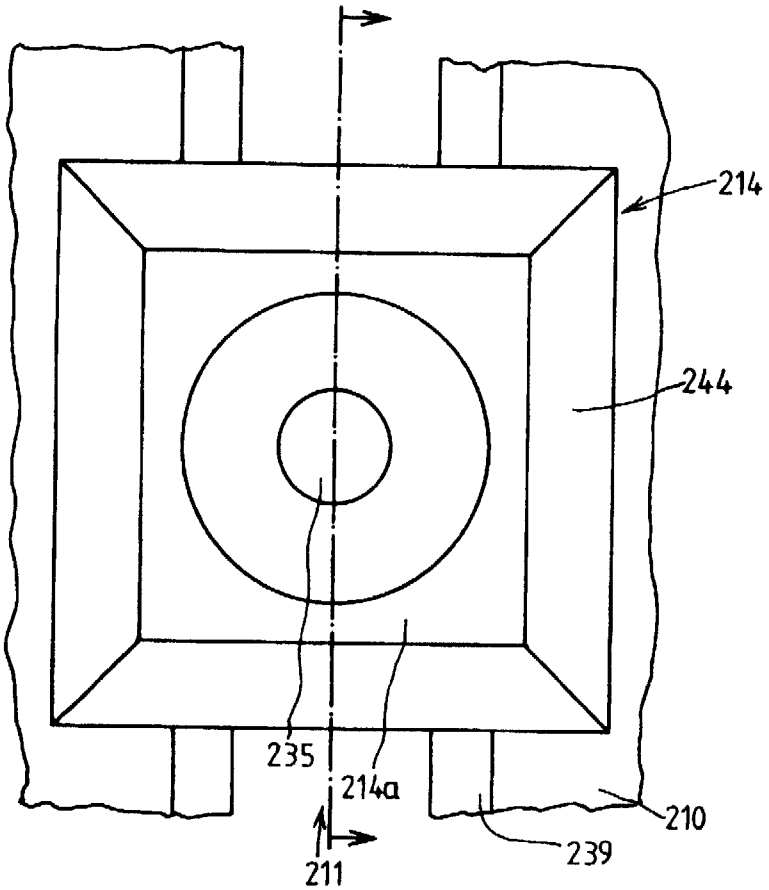
FIG. 10 is an elevational view of another embodiment of a coupling element according to the present invention, which extends outwardly through and overlaps the guide slit of the sliver can.

FIGS. 10 and 11 show an exemplary embodiment of a coupling element 214 configured to extend through the guide slit 211 in the end wall 210 of a can and to overlap the outward surface of the end wall 210. The coupling element 214 has a main body having a head portion 214*a* adapted to overlie the end wall of the can, the head portion being of a square shape and a relatively narrow profile to only project slightly beyond the wall 210 of the can without extending beyond the outer contour 240 of the can defined by the upper and lower can edges (the upper can edge 241 being shown). The square perimeter of the head portion 214*a* of the coupling element is beveled at 244 to taper in the direction toward the can wall 210, so that no edges are created on which anything may become caught. The head portion 214*a* of the coupling element 214 is unitary with a narrower mounting portion which extends through the guide slit 211 between the reinforcing profiles 239 and is affixed to the perimeter flange 209*a* of the bottom wall 209, for example by means of screws 245. The coupling element 214 has a conical, inward tapering recess 235 in the center for the insertion of the manipulators. In the instant embodiment, it will thus be understood to be possible to employ manipulators 312 in accordance with FIG. 6, with which the bottom wall 209 can be raised and lowered. This embodiment of a coupling element allows other handling of the can, e.g., pushing off and pulling onto a can changing mechanism, by means of a magnet 500 disposed on a can changing mechanism 223 for movement toward the coupling element in the direction of the arrow 529, as represented in FIG. 11. To better enable the magnet to handle the can, the head portion 214*a* of the coupling element 214 overlying the guide slit 211 is made of a magnetizable material. A can transport vehicle with such a can manipulating device is known from German Patent Publication DE 43 23 726 A1.

Figure 13:
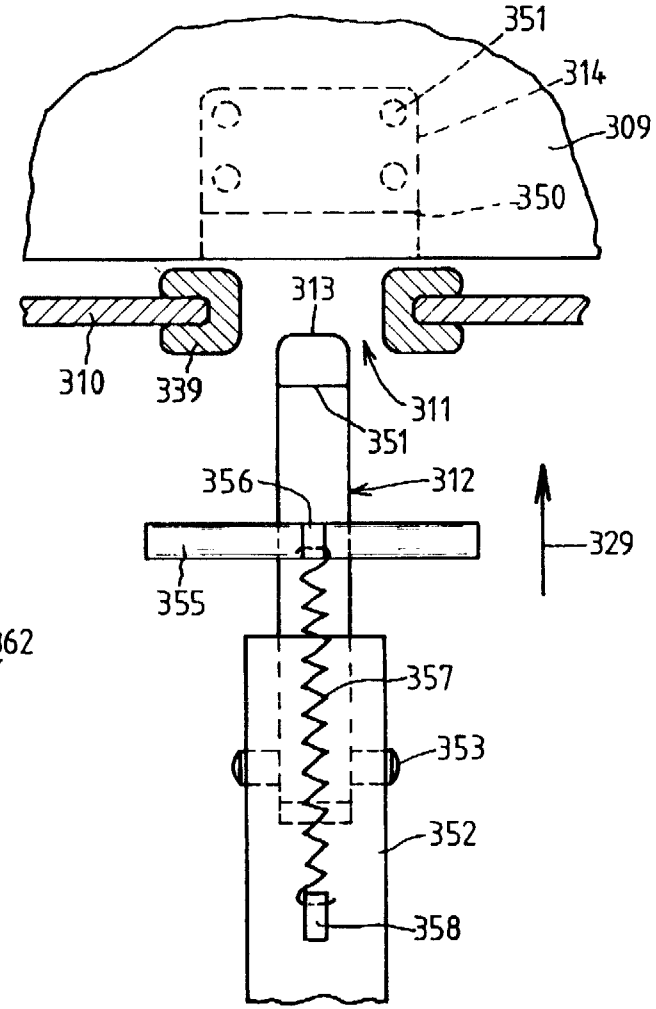
FIG. 13 is a top view of the manipulator in FIG. 12 shown advancing into the coupling element.
Figure 12:
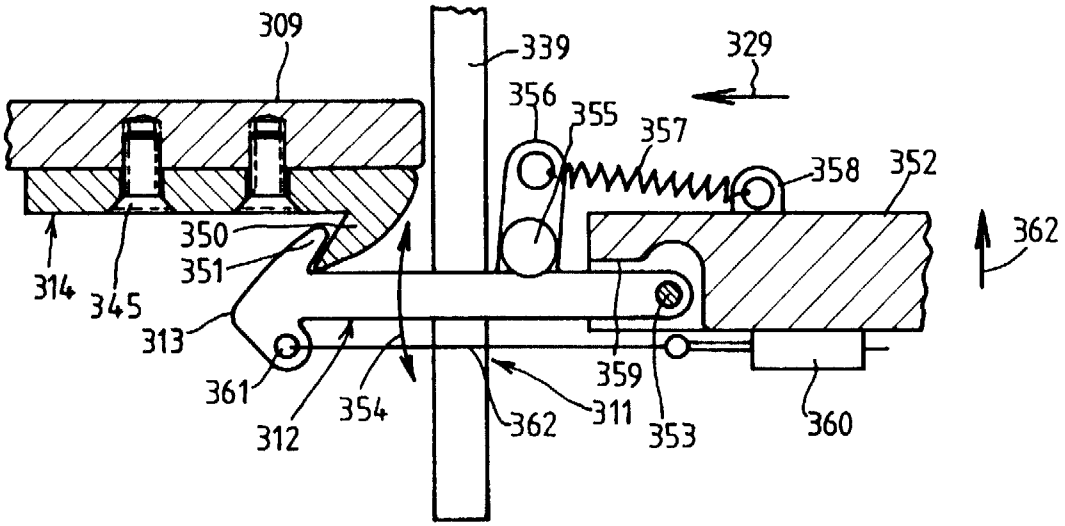
FIG. 12 is a side elevational view, partially in section, of another embodiment of a coupling element which comprises a tooth-like head portion suited to be engaged with a compatible toothed manipulator.

Another exemplary embodiment of a coupling element 314 is shown in FIGS. 12 and 13, which is configured as an latching element 350 to be engageable with a manipulator 312 formed with a mating hook 351 at its tip 313. FIG. 13 is a top view of the manipulator 312 with a portion of a handling device 352 of a can transport vehicle (not shown) on which the manipulator is mounted, as it is delivered in the direction of the arrow 329 from the handling device 352 to the coupling element 314 of a sliver can. FIG. 12 is a sectional view of the can taken along the guide slit 311 of the can wall 310 (FIG. 13) adjacent the reinforcement profile 339 in the area of the bottom wall 309, showing the coupling element 314 fastened on the underside of the bottom wall by screws 345 and depicting its latching element 350 engaged by the manipulator 312. The manipulator 312 has been extended in the direction 329 from the handling device 352 of the can transport vehicle through the guide slit 311 into interlocking toothed engagement by the hook 351 with the latching element 350 of the coupling element 314. The can may be pushed and pulled laterally in this position of the manipulator.

As indicated by the arrow 354, the manipulator 312 is vertically pivotable about a horizontal hinge 353 on a handling device 352 which can be extended and retracted to and from the can transport vehicle. A push bar 355 for pushing the cans is attached to the manipulator 312 at a right angle thereto at a spacing from the hooked outer end, which permits the forward movement by the coupling element. The lateral dimension of the push bar approximates or slightly exceeds the width of the guide slit 311. A bracket 356 is disposed on the push bar 355 above the manipulator 312, and a tension spring 357 extends between the bracket 356 and a bracket 358 on the handling device 352 to act to pull the manipulator 312 upwardly against a stop surface 359 on the handling device 352 to maintain the manipulator in the horizontal direction. Both the tip 313 of the manipulator 312 and the latching portion 350 of the coupling element 314 are tapered. Thus, in the course of making an interlocking connection with the coupling element 314, if the manipulator 312 engages against the latching portion 350 of the coupling element 314, it is downwardly deflected against the force of the spring 357, as indicated by arrow 354, until the hook 351 snaps behind the latching portion 350.

To release the manipulator 312 from the latching portion 350, a solenoid 360 in the instant embodiment is attached to the underside of the handling device 352 with a cable or a rod extending from the solenoid 360 to an ear portion 361 disposed below the hook 351 of the manipulator 312. When the solenoid 360 is actuated, the manipulator 312 is pulled downward against the force of the spring 357 and is released from the abutment 350. As a result, the coupling element 314 is released and the manipulator 312 can be pulled back with the handling device 352.

The manipulator 312 can also be used for raising and lowering the bottom wall 309 of the sliver can. In the course of being raised in the direction of the arrow 362 by means of the handling device 352, the manipulator 312 pivots downwardly about its hinge 353 under the weight of the bottom wall 309 resting thereon, but the extent of such pivoting is limited by the push bar 355 which is brought into resting engagement against the reinforcement 339 along the guide slit 311 of the can wall 310. During such raising movement of the bottom wall 309, the push bar 355 slides along the reinforcing profile 339 of the guide slit 311.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A sliver can having a side wall and a vertically displaceable bottom wall, the side wall defining a laterally outermost can contour and having vertical guide slits formed in the side wall, the bottom wall having coupling elements disposed adjacent the guide slits, the coupling elements being connectable with can manipulators to follow a vertical movement of the manipulators, the coupling elements being disposed within the can contour, and the coupling elements and the guide slits being compatibly configured to permit insertion of the manipulators laterally into the coupling elements.

2. The sliver can in accordance with claim 1, wherein the coupling elements have a portion configured for interlocking connection with the manipulators for additionally following lateral movements of the manipulators for pushing and pulling movements of the cans.

3. The sliver can in accordance with claim 1, wherein the coupling elements and the slits in the side wall are arranged to receive the manipulators in interior engagement with the side wall of the can for additionally following lateral movements of the manipulators for pushing and pulling movements of the can.

4. The sliver can in accordance with claim 1, wherein the bottom wall defines a laterally outermost contour and the coupling elements are disposed within the bottom wall contour.

5. The sliver can in accordance with claim 1, wherein the coupling elements extend into the guide slits.

6. The sliver can in accordance with claim 5, wherein each coupling element comprises a portion outwardly overlapping the adjacent guide slit.

7. The sliver can in accordance with claim 6, wherein the outward portion of the coupling element is tapered toward the side wall.

8. The sliver can in accordance with claim 5, wherein the coupling element comprises a magnetizable material.

9. The sliver can in accordance with claim 1, wherein each coupling element defines an inwardly tapering conical recess for insertion therein of the associated manipulator.

10. The sliver can in accordance with claim 1, wherein the can is rectangular and the guide slits are arranged in the narrow sides of the can.

* * * * *